United States Patent [19]

Bachmann

[11] Patent Number: 4,524,897

[45] Date of Patent: Jun. 25, 1985

[54] ELECTRICALLY DRIVEN TACKER OR THE LIKE FOR DRIVING FASTENING ELEMENTS INTO A WORKPIECE

[75] Inventor: Rainer Bachmann, Hohenstein, Fed. Rep. of Germany

[73] Assignee: Black & Decker Inc., Newark, Del.

[21] Appl. No.: 537,803

[22] Filed: Sep. 30, 1983

[30] Foreign Application Priority Data

Oct. 5, 1982 [DE] Fed. Rep. of Germany ..... 3236748

[51] Int. Cl.[3] ..... B25C 1/06

[52] U.S. Cl. ..... 227/131; 227/142

[58] Field of Search ..... 227/131, 142, 156, 120

[56] References Cited

U.S. PATENT DOCUMENTS 3,058,117 10/1962 Moore ..... 227/131 X 4,327,485 5/1982 Rix ..... 227/142 X

FOREIGN PATENT DOCUMENTS 1603827 6/1971 Fed. Rep. of Germany .

2754641 6/1979 Fed. Rep. of Germany ..... 227/131

*Primary Examiner*—Paul A. Bell

*Attorney, Agent, or Firm*—Ronald B. Sherer; Harold Weinstein; Edward D. Murphy

[57] ABSTRACT

With a solenoid actuated tacker the setting of the penetration depth of the fastening elements is effected by adjusting the operating stroke of the armature with respect to the solenoid coil actuating the armature. To accomplish this there is preferably provided an armature stop displaceable in the direction of movement of the armature. The stop is preferably supported and moved by a cam-like element adjustably rotatable about an axis at right angles to the movement of the armature. In this way the drive-in depth of the fastening elements can simply and readily be adjusted.

19 Claims, 5 Drawing Figures

ELECTRICALLY DRIVEN TACKER OR THE LIKE FOR DRIVING FASTENING ELEMENTS INTO A WORKPIECE

FIELD OF THE INVENTION

This invention relates to electronically driven tackers or the like for the driving of fastening elements, such as staples or nails, into a workpiece. Particularly, it relates to solenoid operated tackers or the like in which a driving element is connected to and actuated by the armature of a solenoid.

BACKGROUND OF THE INVENTION

It is known with tackers for the depth of penetration of the fastening element to be adjustable. With tackers known in the art (e.g. German Pat. No. 1,603,827), which are, however, more commonly driven with compressed air, adjusting of the depth of penetration of the fastening elements is effected by modifying the position of the bearing area, or discharge nozzle, of the discharge duct of the fastening elements. To do this the nozzle or duct mouthpiece is moved in the direction of movement of the fastening element, and thus in the direction of movement of the driving element acting upon the fastening element. This usually requires loosening, adjusting, and re-tightening the entire duct mouthpiece or a confining wall of the front area of the discharge duct. Providing for such an adjustment is relatively costly to manufacture. Also, such adjustment is cumbersome to operate. Further, defective operation of the tacker can occur if the user after making such an adjustment does not carefully secure the adjustable part of the tacker that determines the depth of penetration of the fastening elements.

SUMMARY OF THE INVENTION

It is an object of the present invention to provide an electrically driven tacker with which the depth of penetration of the fastening elements is adjustable very simply and reliably.

A feature by which this object is achieved is to have the operating stroke of the solenoid armature adjustable.

This has the advantage that, upon changing the depth of penetration of the fastening elements, no change occurs in the external shape of the tacker. Particularly, no change occurs to or in the vicinity of the discharge duct, instead the stroke of the driving element acting upon the fastening elements is changed by an adjustment to the operating stroke of the armature of the solenoid.

There is provided, therefore, according to the present invention an electrically driven tacker or the like for driving fastening elements into a workpiece, having a driving element impacting onto the fastening element, the driving element being connected to a solenoid actuatable armature, and the drive-in depth of the fastening element being adjustable by adjusting the operating stroke of the armature.

Preferably, the armature is movable substantially coaxially with respect to the coil of the solenoid, and the driving movement of the armature is limited by a stop, the stop being adjustable in the direction of movement of the armature. Preferably, the stop comprises a pad of elastically deformable material, for example rubber, that is positioned to be impacted by one end of the armature during the driving stroke.

Preferably, the side of the stop away from the armature is braced against a circumferential area of a pressure element. The pressure element may be rotatably mounted on a shaft supported at right angles to the direction of movement of the armature. The pressure element may have circumferential area segments having different radial distances from the rotatable axis of the shaft. Thus, the position of the stop, and thus also the length of the operating stroke of the armature, can be adjusted merely by rotating the pressure element.

Other objects, features and advantages of the invention will become more fully apparent from the following detailed description of the preferred embodiments, the appended claims and the accompanying drawings.

DETAILED DESCRIPTION OF THE PREFERRED EMBODIMENTS

The features in common to the two embodiments illustrated in FIGS. 1 and 2 will first be described in relation to FIGS. 1 through 5. Thereafter, the differences between the embodiments of FIGS. 1 and 2 will be described.

Figure 1:
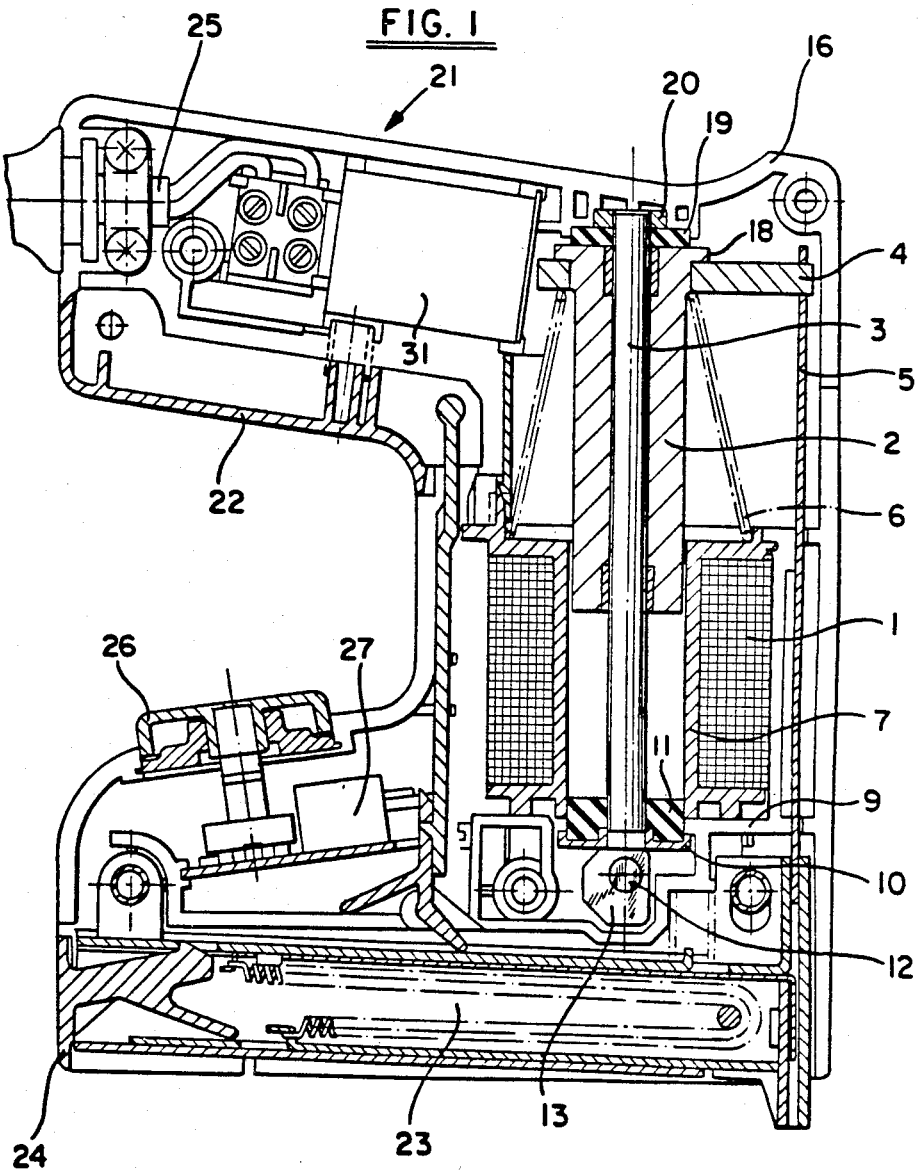
FIG. 1 schematically illustrates a vertical section through an electrically driven tacker according to the invention.

FIG. 1 shows a vertical section through a tacker having a housing made of two half shells of which only the half shell 16 can be seen in FIG. 1. These half shells are formed with a handle area 21 into which there extends an electrical connecting cable 25. A switch actuating lever 22 is pivoted adjacent the rear end of the handle 21 and is depressable thereinto. In the lower portion of the housing is a staple magazine 23 with a spring loaded closure 24 both constructed in a manner that is well known in the art. Mounted in the lower portion of the housing above the staple magazine 23 is a rotary control knob 26 of a potentiometer electrically connected to an electronic control system 27 for adjusting the drive-in power of the stapler.

The connecting cable 25 is electrically connected to a solenoid coil 1 via a switch 31 actuatable by the lever 22. The solenoid coil has an inner shell 7 provided with end flanges and has a central bore to accommodate an armature 2. The solenoid coil unit 1 is secured to one of the supporting partitions 9 formed by the half shells of the housing, which partition 9 has a central opening registering coaxially with the lower end of the bore through the shell 7. Through the center of the bore of the shell 7 there extends a guide rod 3 which is mounted at its upper end in an annular collar 20 supported in a cavity in the two shell halves of the housing. Also mounted in this cavity below the collar 20 is an annular rubber washer 19. The lower end of the guide rod 3 is mounted in a stop consisting of an annular supporting ring 10 in which is mounted a resilient rubber pad 11 also of annular configuration. The armature 2, which is made of ferromagnetic material, is slidably mounted concentrically on the guide rod 3. At the upper end of the armature 2 is an outwardly extending annular flange 18 against the lower surface of which is firmly secured a bracket 4. The bracket 4 surrounds the armature 2 and has an arm extending to the right thereof which is drivingly secured in known manner to a downwardly extending driving element 5 of blade-like configuration. The armature 2 is yieldably urged upwards by a frusto-conical coil spring 6 compressed between the upper flange of the solenoid shell 7 and the underside of the bracket 4. In this way the armature 2 is normally held in an upper position with its flange 18 engaging against the resilient washer 19. In this position the driving blade 5 is also retracted to an upper position ready to discharge, or fire, the next staple from the magazine 23.

In operation when the lever 22 is manually depressed, an induction current passes through the solenoid coil 1, whereupon the armature 2 is pulled into the solenoid coil 1 moving with it the bracket 4 and the driving element 5 to discharge a staple from the magazine 23. The armature 2 moves downwardly against the force of the spring 6 until it strikes and is stopped by the resilient pad 11. Thus, the pad 11 and its supporting ring 10 determine the operating stroke of the armature 2 and, therefore, also the downward movement of the driving element 5.

The position of the resilient pad 11 in the central bore of the solenoid coil unit 1 is determined by a cam-like pressure element 13 which is mounted on a shaft 12 for rotation therewith as will be described more fully later.

Figure 2:
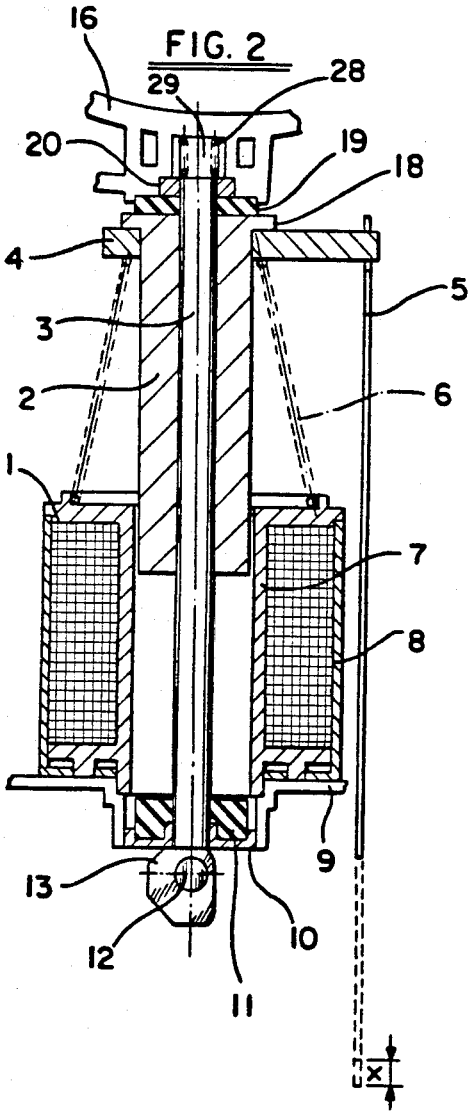
FIG. 2 illustrates a vertical section, similar to part of FIG. 1, showing the drive, the driving element, and the arrangement for adjusting the operating stroke of the armature of a modified embodiment of a tacker according to the present invention.
Figure 3:
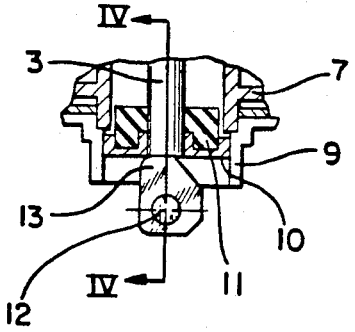
FIG. 3 shows the lower part of FIG. 2 with the pressure element for adjusting the armature stroke in another position.

FIG. 2 is similar to a portion of FIG. 1 and shows the guide rod 3, armature 2 slidable thereon, the solenoid coil 1 with its inner shell 7, the resilient pad 11 with its supporting ring 10, and the cam-like pressure element 13 mounted on the shaft 12. The driving element 5 is more clearly shown, and its extent of downward movement is indicated by the broken lines. With the pressure element 13 in the orientation shown in FIGS. 1 and 2, the pad 11 is supported in its lowermost position allowing the maximum downward stroke of the driving element 5 to the end of the broken lines. When the shaft 12 and the pressure element 13 are rotated through 180° to the position shown in FIG. 3, the resilient pad 11 is moved upwardly in the bore of the solenoid coil unit 1 to its uppermost position. In the orientation of FIG. 3, the driving element 7 has its shortest downward stroke. The distance x indicated in FIG. 2 illustrates the difference between the maximum and shortest downward strokes of the driving element 5.

Figure 4:
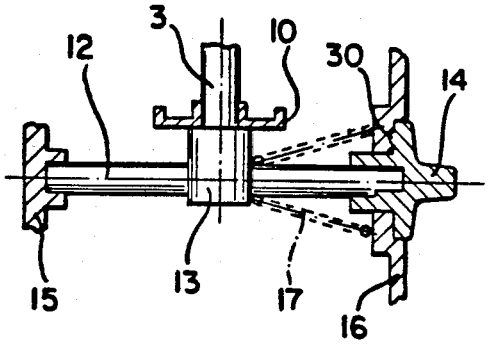
FIG. 4 illustrates a partial section on the line IV—IV of FIG. 3.

FIG. 4 is a section on the line IV—IV of FIG. 3 and is applicable to both FIGS. 1 and 2. The pressure element 13 can be seen mounted midway along the length of the shaft 12. One end of the shaft 12 is rotatably mounted in the other half shell 15 of the tacker housing, and the other end of the shaft 12 is firmly secured in a boss of a knob 14, the knob 14 being rotatably mounted in the half shell 16. The shaft 12, and knob 14, are slidable axially, and a frusto-conical coil spring compressed between the pressure element 13 and the half shell 16 urges the shaft 12 to the left in FIG. 4. A flange of the knob 14 is formed with an inwardly facing detent protrusion 30 which is engagable in a series of recesses or slots in the half shell 16. To change the position of the pressure element 13, and also the length of stroke of the driving element 5, the knob 14 is pulled outwards to disengage the detent 30 and then rotated to a selected position, whereupon release of the knob 14 causes it to move inwardly under the action of th spring 17, the detent 30 then engaging another one of the series of recesses to lock the knob 14 in position.

Figure 5:
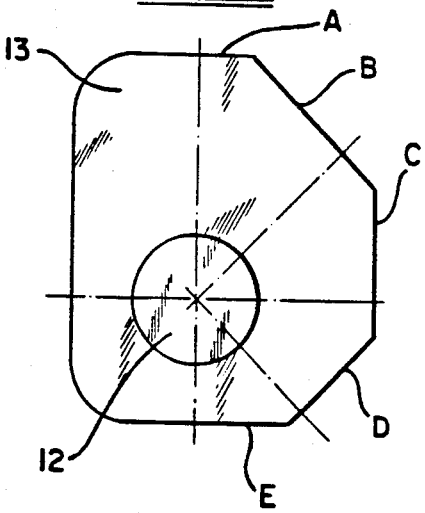
FIG. 5 shows on a larger scale the pressure element oriented as in FIG. 3.

FIG. 5 shows on a larger scale the pressure element 13 orientated in the position of FIG. 3. The pressure element 13 is eccentrically mounted on the shaft 12 and includes five peripheral area segments A, B, C, D and E. Between the peripheral area segments A and E is a straight side curved at its ends and generally parallel to the peripheral segment C. The flat peripheral area A is at the maximum radial distance from the central axis of the shaft 12, and the flat peripheral area segment E is at the minimum radial distance from the axis of the shaft 12. The flat segments B, C and D are at intermediate radial distances from the axis of the shaft 12 providing a stepwise reduction in radial distance from that of segment A to that of segment E as can be clearly seen in FIG. 5.

Thus, in operation the knob 14 can be rotated to select the peripheral area segment of the pressure element 13 to support the resilient pad 11 and supporting ring 10, to adjust the operating stroke of the driving element 5. FIGS. 1 and 2 show the peripheral segment E positioning the pad 11, while FIG. 3 shows the peripheral segment A positioning pad 11, representing the maximum and minimum penetrating strokes of the driving element 5, respectively. Intermediate drive-in depths for the staples, or fastening elements, are obtained by positioning a selected one of the other flat peripheral segments B, C or D uppermost to contact and support the supporting ring 10.

The differences between the embodiments of FIGS. 1 and 2 will now be described.

In FIG. 1 the upper end of the guide rod 3 is firmly secured in the annular collar 20 which in turn is firmly secured in the tacker housing to retain the guide rod 3 in the position shown. The resilient pad 11 and its supporting ring 10 are slidably mounted on the lower end of the guide rod 3, the pad 11 also being slidable in the bore of the inner shell 7. With the pressure element 13 orientated as shown with the peripheral segment E uppermost, the lower end of the guide rod 3 is spaced above the pressure element 3 a distance slightly greater than the distance x illustrated in FIG. 2. Thus, during rotation of the pressure element 13, the guide rod 3 remains stationary and the resilient pad 11 slides upwardly and downwardly on the lower end of the guide rod 3.

In the embodiment of FIG. 2, the upper end of the guide rod 3 is slidably mounted in the annular collar 20. A recess 29 is provided in the half shells 15, 16 to accommodate upward movement of the guide rod 3. A coil spring 28 is located in the recess 29 and compressed between the upper end of the guide rod 3 and the upper wall of the tacker housing to resiliently urge the guide rod 3 downwards. The cup-like annular supporting ring 10 is firmly secured to the lower end of the guide rod 3 so that the guide rod 3 and the resilient pad 11 move in unison. The pressure element 13 contacts both the lower end of the guide rod 3 and the supporting ring 10. As the pressure element 13 is rotated clockwise from the position in FIG. 2 to the position in FIG. 3, the guide rod 3 is moved upwardly through the annular collar 20 against the force of the spring 28. During anti-clockwise rotation of the pressure element 13 from the minimum stroke position of FIG. 3 to the maximum stroke position of FIG. 2, the spring 28 urges the guide rod 3 downwardly retaining its lower end in contact with the periphery of the pressure element 13. Also in FIG. 2, the solenoid coil 1 is provided with an outer cover 8 having an inturned annular flange at its lower end.

It will be appreciated that both the above embodiments of the invention provide a simple, effective, and reliable mechanism for readily adjusting the operating stroke of the solenoid armature. To obtain the desired drive-in depth for any particular fastening element, the operator simply has to disengage the detent 30, rotate the knob 14 to the desired setting, and then release the knob 14 for the detent 30 to re-engage in the new setting. Although five operative peripheral area segments are provided on the pressure element 13, it will be appreciated that more or less such segments could be provided as required, for example six or three, respectively.

The above described embodiments, of course, are not to be construed as limiting the breadth of the present invention. Modifications, and other alternative constructions, will be apparent which are within the spirit of the invention and the scope of the appended claims.

What is claimed is:

1. An electrically driven tacker for driving fastening elements into a workpiece, comprising:

a housing;

a driving element for impacting onto and driving a a fastening element;

a solenoid mounted in said housing and having an armature drivingly connected to said driving element;

means for adjusting the length of the operating stroke of said armature whereby the drive-in depth of the fastening element can be adjusted;

a guide rod upon which said armature is slidably mounted;

said driving element being spaced from and parallel to said guide rod;

one end of said guide rod being located by said housing and the other end of said guide rod engaging said adjusting means; and said armature moving towards and being stopped by said adjusting means during driving-in of the fastening element.

2. The electrically driven tacker of claim 1, wherein said adjusting means comprises a cam-like pressure element which adjustably positions a resilient stop to determine the length of said operating stroke.

3. The electrically driven tacker of claim 2, wherein said pressure element is rotatable about an axis at right angles to the movement of said armature during said operating stroke, said pressure element having a plurality of circumferential area segments which are each spaced a different radial distance from said axis.

4. The electrically driven tacker of claim 3, wherein said stop comprises a resilient pad supported by a cup-like supporting ring, and each of said circumferential area segments is flat.

5. The electrically driven tacker of claim 1, wherein said solenoid has a solenoid coil with a bore through the center thereof, said guide rod extends through said bore and said armature is movable along said bore, said driving element is disposed outside said solenoid coil, and said armature is connected to said driving element by a bracket extending transversely from said armature.

6. The electrically driven tacker of claim 1, wherein said armature is resiliently biased towards said one end of said guide rod, and said adjusting means comprises a stop member mounted on said other end of said guide rod and adjustably movable by a cam into an end of said bore.

7. An electrically driven tacker for driving fastening elements into a workpiece, comprising:

a housing;

a solenoid comprising a solenoid coil having a bore through the center thereof and an armature movable in said bore, said coil being mounted in said housing;

a driving element connected to said armature to be driven thereby for impacting onto and driving said fastening elements;

a stop movably engaged in one end of said bore, said stop determing the length of the operating stroke of said armature;

means for supporting said stop and adjustably determining the position of said stop axially in said bore, whereby the drive-in depth of said fastening elements can be adjusted; and a guide rod concentric with said bore, said armature being slidably mounted on said guide rod, one end of said guide rod being located by said housing and the other end of said guide rod engaging said stop.

8. The electrically driven tacker of claim 11, wherein said supporting means comprises a cam-like pressure element rotatable about an axis at right angles to the movement of said armature in said bore.

9. The electrically driven tacker of claim 8, wherein said cam-like pressure element has a plurality of flat circumferential area segments which are each spaced a different radial distance from said axis.

10. The electrically driven tacker of claim 9, wherein said cam-like pressure element is secured on a shaft which is rotatably mounted in said housing, and a knob is mounted on one end of said shaft for manual rotational adjustment thereof.

11. The electrically driven tacker of claim 10, wherein said knob has a detent cooperable with said housing for releasably retaining said cam-like pressure element in a selected orientation with a selected one of said circumferential segment areas engaging and supporting said stop.

12. The electrically driven tacker of claim 11, wherein said stop comprises a resilient pad mounted in a cup-like supporting ring, said supporting ring being engaged by said pressure element.

13. The electrically driven tacker of claim 7, wherein said one end of said guide rod is non-movably secured relative to said housing, and said stop comprises an annular resilient pad which slidably engages on said other end of said guide rod.

14. The electrically driven tacker of claim 7, wherein said guide rod is movably mounted relative to said housing and said coil and moves with said stop when the position of the latter is adjusted by said supporting means.

15. The electrically driven tacker of claim 14, wherein said guide rod is resiliently biased by a spring towards said supporting means, said spring acting between said one end of said guide rod and said housing.

16. The electrically driven tacker of claim 15, wherein said stop comprises an annular resilient pad mounted on said other end of said guide rod and said guide rod is biased by said spring into engagement with said supporting means.

17. An electrically driven tacker for driving fastening elements into a workpiece, comprising:

a housing having a handle;

a solenoid comprising a solenoid coil having a central bore therethrough and an armature movable axially in said bore; said coil being non-movably mounted in said housing;

a driving element connected to said armature to be driven thereby for impacting onto and driving said fastening elements;

a guide rod concentric with said bore, said armature being slidably mounted on said guide rod, one end of said guide rod being located by said housing;

a resilient annular pad mounted in a cup-like supporting ring, the other end of said guide rod engaging in the center of said annular pad, and said annular pad slidably engaging in one end of said bore;

a cam-like element rotatably mounted in said housing about an axis at right angles to the movement of said armature in said bore, said cam-like element having a plurality of flat circumferential area segments each spaced a different radial distance from said axis;

said supporting ring being supported by a selected one of said circumferential area segments to determine the axial position of said annular pad in said bore and so determine the length of the operating stroke of said armature; and a knob connected to said cam-like element for manual rotation thereof, whereby the drive-in depth of said fastening elements can be adjusted by causing different ones of said circumferential area segments to support said supporting ring.

18. The electrically driven tacker of claim 17, wherein said one end of said guide rod is secured to said housing, and said annular pad is slidably mounted on said other end of said guide rod.

19. The electrically driven tacker of claim 17, wherein said guide rod is resiliently biased into contact with said cam-like element.

* * * * *